US009595223B2

(12) United States Patent
Yang et al.

(10) Patent No.: US 9,595,223 B2
(45) Date of Patent: Mar. 14, 2017

(54) PIXEL DRIVING CIRCUIT AND DRIVING METHOD THEREOF, ARRAY SUBSTRATE AND DISPLAY APPARATUS

(71) Applicant: BEIJING BOE OPTOELECTRONICS TECHNOLOGY CO., LTD., Beijing (CN)

(72) Inventors: Shengji Yang, Beijing (CN); Junwei Wu, Beijing (CN); Yingming Liu, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 244 days.

(21) Appl. No.: 14/093,191

(22) Filed: Nov. 29, 2013

(65) Prior Publication Data

US 2014/0152191 A1 Jun. 5, 2014

(30) Foreign Application Priority Data

Nov. 30, 2012 (CN) ..... 2012 1 0506142

(51) Int. Cl.
*G09G 3/32* (2016.01)

(52) U.S. Cl.
CPC ... *G09G 3/3233* (2013.01); *G09G 2310/0251* (2013.01); *G09G 2320/0233* (2013.01); *G09G 2320/045* (2013.01)

(58) Field of Classification Search
CPC ..... G09G 3/3233–3/3258; G09G 2300/0439–2300/0465; G09G 2310/0251; G09G 2320/0233; G09G 2320/045
(Continued)

(56) References Cited

U.S. PATENT DOCUMENTS 7,057,588 B2 * 6/2006 Asano ..... G09G 3/3233 345/76
2003/0112205 A1 6/2003 Yamada
2014/0118231 A1 5/2014 Yang et al.

FOREIGN PATENT DOCUMENTS

CN 1427382 A 7/2003
CN 102651192 A 8/2012
(Continued)

OTHER PUBLICATIONS

Third Chinese Office Action Appln. No. 201210506142.6; dated Apr. 13, 2015.
(Continued)

*Primary Examiner* — Stephen Sherman
(74) *Attorney, Agent, or Firm* — Ladas & Parry LLP

(57) ABSTRACT

The embodiments of the present disclosure provide a pixel driving circuit and a driving method thereof, an array substrate and a display apparatus, which is able to avoid an influence on a driving current of an active light emitting device caused by a drift in a threshold voltage of a driving transistor. The pixel driving circuit comprises a data line, a first scan line, a second scan line, a signal controlling line, a light emitting device, a storage capacitor, a driving transistor, a first switch transistor, a second switch transistor, a third switch transistor, a fourth switch transistor and a fifth switch transistor. The embodiments of the present disclosure may be applied to a display manufacture.

13 Claims, 7 Drawing Sheets

(58) Field of Classification Search
USPC ..... 345/76–82; 315/169.3
See application file for complete search history.

(56) References Cited

FOREIGN PATENT DOCUMENTS

| | | | |
|---|---|---|---|
| CN | 102708819 | A | 10/2012 |
| CN | 202905119 | U | 4/2013 |

OTHER PUBLICATIONS

First Chinese Office Action dated Jun. 5, 2014; Appln. No. 201210506142.6.
Second Chinese Office Action Appln. No. 201210506142.6; Dated Dec. 15, 2014.

* cited by examiner

PIXEL DRIVING CIRCUIT AND DRIVING METHOD THEREOF, ARRAY SUBSTRATE AND DISPLAY APPARATUS

TECHNICAL FIELD

The present disclosure relates to a field of display technique, and particularly, to a pixel driving circuit and a driving method thereof, an array substrate and a display apparatus.

BACKGROUND

An Active Matrix Organic Light Emitting Diode (AMOLED) display is one of hotspots in a field of flat display research currently. As compared with a liquid crystal display, the Organic Light Emitting Diode (OLED) has advantages of a low power consumption, a low cost of production, a self-luminescent feature, a wide angle of view, a rapid response speed and so on, and has begun to replace a traditional LCD display screen in the display fields of a mobile phone, a PDA (Personal Digital Assistant), a digital photo frame, etc. A design for a pixel driving circuit is a core technique for the AMOLED display and has important research significance.

Unlike a TFT-LCD (Thin Film Transistor Liquid Crystal Display) which controls brightness by a stable voltage, the OLED is driven by a current and requires a stable current to control its light-emitting. In an existing driving circuit having two transistor T1, T2 and one storage capacitor C1(as illustrated in FIG. 1), a driving current $I_{OLED}$ is a current generated by a voltage $V_{data}$, provided from a data line, acting on a saturation region of a driving transistor (DTFT). This current drives the OLED to emit light, wherein a calculation formula of the driving current is $I_{OLED}=K(V_{GS}-V_{th})^2$, where $V_{GS}$ is a voltage between a gate and a source of the driving transistor, $V_{th}$ is a threshold voltage of the driving transistor. For the reasons of the technology processes, device degradations and the like, there is an unhomogeneity among the threshold voltages ($V_{th}$) of the driving TFTs in the respective pixels. The unhomogeneity existing among the threshold voltages of the driving TFTs (for example, T2 in FIG. 1) in the respective pixels results in changes in the currents flowing through each pixel OLED, and in turn affects a display effect of an entire image.

SUMMARY

Embodiments of the present disclosure provide a pixel driving circuit and a driving method thereof, an array substrate and a display apparatus, which can avoid an influence on a driving current of an active light emitting device, caused by a drift in a threshold voltage of a driving transistor and may in turn improve homogeneity in a displayed image.

In view of this, the embodiments of the present disclosure utilize solutions as follows.

According to an aspect of the present disclosure, there is provided a pixel driving circuit comprising a data line, a first scan line, a second scan line, a signal controlling line, a light emitting device, a storage capacitor, a driving transistor, a first switch transistor, a second switch transistor, a third switch transistor, a fourth switch transistor and a fifth switch transistor;

a gate of the first switch transistor is connected to the signal controlling line, a source of the first switch transistor is connected to a first level terminal, and a drain of the first switch transistor is connected to a first electrode of the storage capacitor;

a gate of the second switch transistor is connected to the first scan line, a source of the second switch transistor is connected to a low level, and a drain of the second switch transistor is connected to a second electrode of the storage capacitor;

a gate of the third switch transistor is connected to the second scan line, a source of the third switch transistor is connected to the second electrode of the storage capacitor;

a gate of the fourth switch transistor is connected to the first scan line, a source of the fourth switch transistor is connected to the data line, and a drain of the fourth switch transistor is connected to the drain of the third switch transistor;

a gate of the driving transistor is connected to the drain of the fourth switch transistor, and a source of the driving transistor is connected to the first electrode of the storage capacitor;

a gate of the fifth switch transistor is connected to the first scan line, a source of the fifth switch transistor is connected to a drain of the driving transistor, and a drain of the fifth switch transistor is connected to the low level;

one electrode of the light emitting device is connected to the drain of the driving transistor, and the other electrode of the light emitting device is connected to a second level terminal.

Optionally, all of the first switch transistor, the second switch transistor, the fourth switch transistor and the fifth switch transistor are N-type switch transistors, the driving transistor is a P-type switch transistor, and the third switch transistor is the N-type or P-type switch transistor.

Optionally, all of the first switch transistor, the second switch transistor, the fourth switch transistor, the fifth switch transistor and the driving transistor are the P-type switch transistors, and the third switch transistor is the N-type or P-type switch transistor.

Optionally, the first scan line and the second scan line are input a same timing scan signal when the third switch transistor adopts a switch transistor having a different type from types of the second switch transistor and the fourth switch transistor.

According to another aspect of the present disclosure, there is provided a driving method for a pixel driving circuit, comprising:

in a first stage, a first switch transistor, a second switch transistor, a fourth switch transistor and a fifth switch transistor are turned on, a third switch transistor is turned off, and a first level terminal charges a storage capacitor;

in a second stage, the second switch transistor, the fourth switch transistor and the fifth switch transistor are turned on, the first switch transistor and a third switch transistor are turned off, and the storage capacitor is discharged until a voltage difference between a gate and a source of a driving transistor is equal to a threshold voltage of the driving transistor;

in a third stage, the first switch transistor and the third switch transistor are turned on, the second switch transistor, the fourth switch transistor and the fifth switch transistor are turned off, and the first level terminal and a second level terminal apply an ON signal to a light emitting device.

Optionally, all of the first switch transistor, the second switch transistor, the fourth switch transistor and the fifth switch transistor are N-type switch transistors, the driving transistor is a P-type switch transistor, and the third switch transistor is the N-type or P-type switch transistor.

Optionally, all of the first switch transistor, the second switch transistor, the fourth switch transistor, the fifth switch transistor and the driving transistor are the P-type switch transistors, and the third switch transistor is the N-type or P-type switch transistor.

According to a further aspect of the present disclosure, there is provided an array substrate comprising the above pixel driving circuit.

According to a still aspect of the present disclosure, there is provided a display apparatus comprising the above array substrate.

The embodiments of the present disclosure provide a pixel driving circuit and a driving method thereof, an array substrate and a display apparatus, which may avoid an influence on a driving current of an active light emitting device caused by a drift in a threshold voltage of a driving transistor in a manner of voltage compensation and may in turn improve a homogeneity in a displayed image.

BRIEF DESCRIPTION OF THE DRAWINGS

In order to explain solutions in embodiments of the present disclosure or the prior art more clearly, drawings required as describing the embodiments of the present disclosure or the prior art will be introduced briefly below. Obviously, the drawings described below are only some embodiments of the present disclosure, but those ordinary skilled in the art may obtain other drawings according to these drawings without any inventive labors.

DETAILED DESCRIPTION

Figure 1:
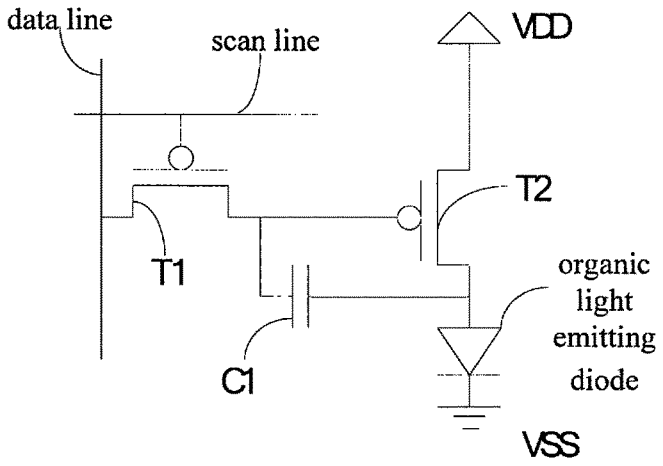
FIG. 1 is an exemplary view illustrating a structure of a pixel driving circuit provided in the prior art.

Thereafter, solutions of embodiments of the present disclosure will be described clearly and completely in connection with drawings of the embodiments of the present disclosure, but obviously the described embodiments are only some, but not all of the embodiments of the present disclosure. Any other embodiments obtained by those ordinary skilled in the art based on the embodiments of the present disclosure without inventive labors should fall into a scope sought for protection in the present disclosure.

Switch transistors and driving transistors adopted in all of the embodiments of the present disclosure may be thin film transistors, field effect transistors or any other devices having similar characteristics. A source and a drain of the switch transistor herein may be exchanged since the source and the drain are symmetrical. In the embodiments of the present disclosure, one of two electrodes except for a gate of the transistor is referred to as the source, and the other is referred to as the drain, in order to distinguish between the two electrodes. In accordance with a configuration in the drawings, a middle terminal of the transistor is specified as the gate, a signal inputting terminal is specified as the source, and a signal outputting terminal is specified as the drain. Further, the switch transistors adopted in the embodiments of the present disclosure comprises both P-type and N-type switch transistors, wherein the P-type switch transistor is turned on when its gate is at a low level and is turned off when its gate is at a high level, while the N-type switch transistor is turned on when its gate is at the high level and is turned off when its gate is at the low level.

Figure 2:
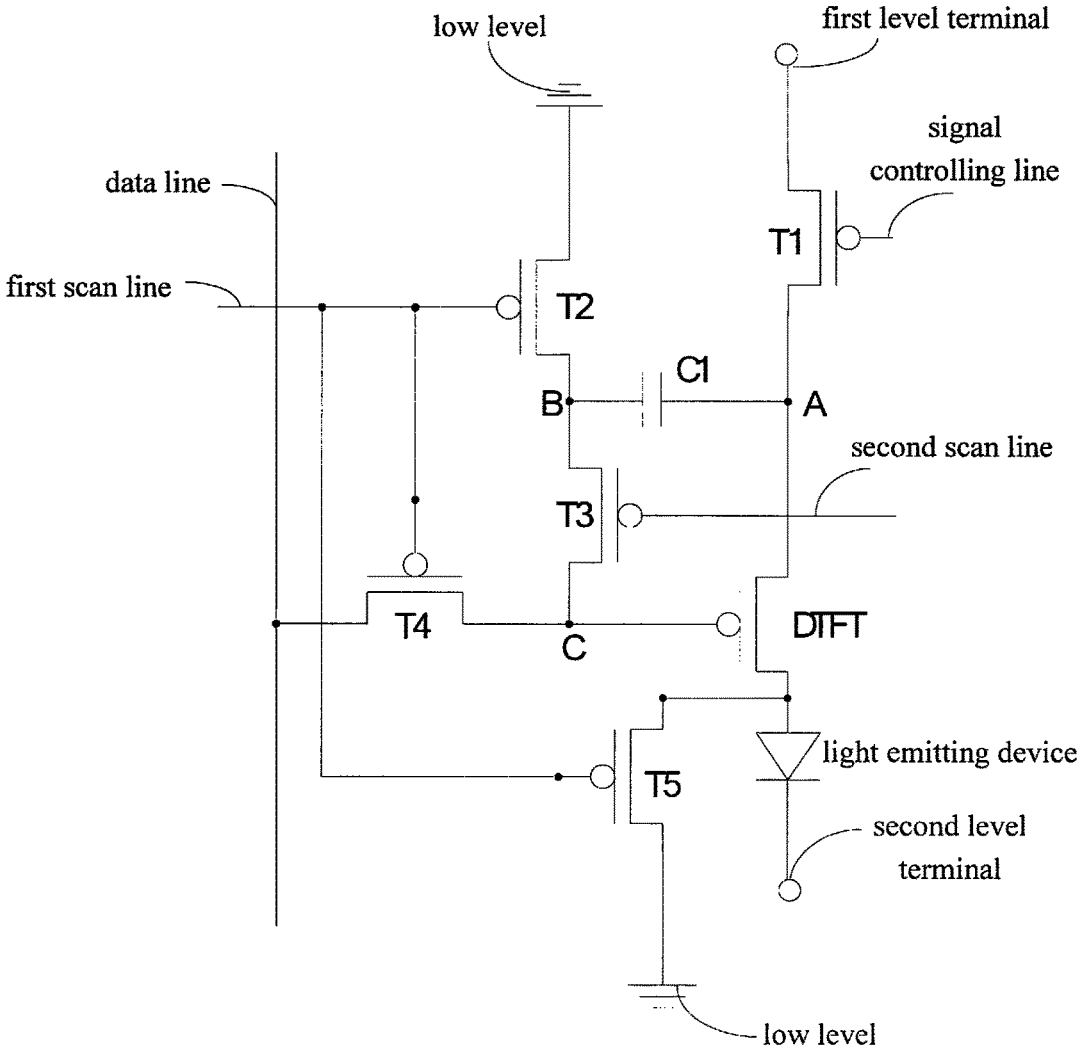
FIG. 2 is an exemplary view illustrating a structure of a pixel driving circuit provided in an embodiment of the present disclosure.
Figure 2A:
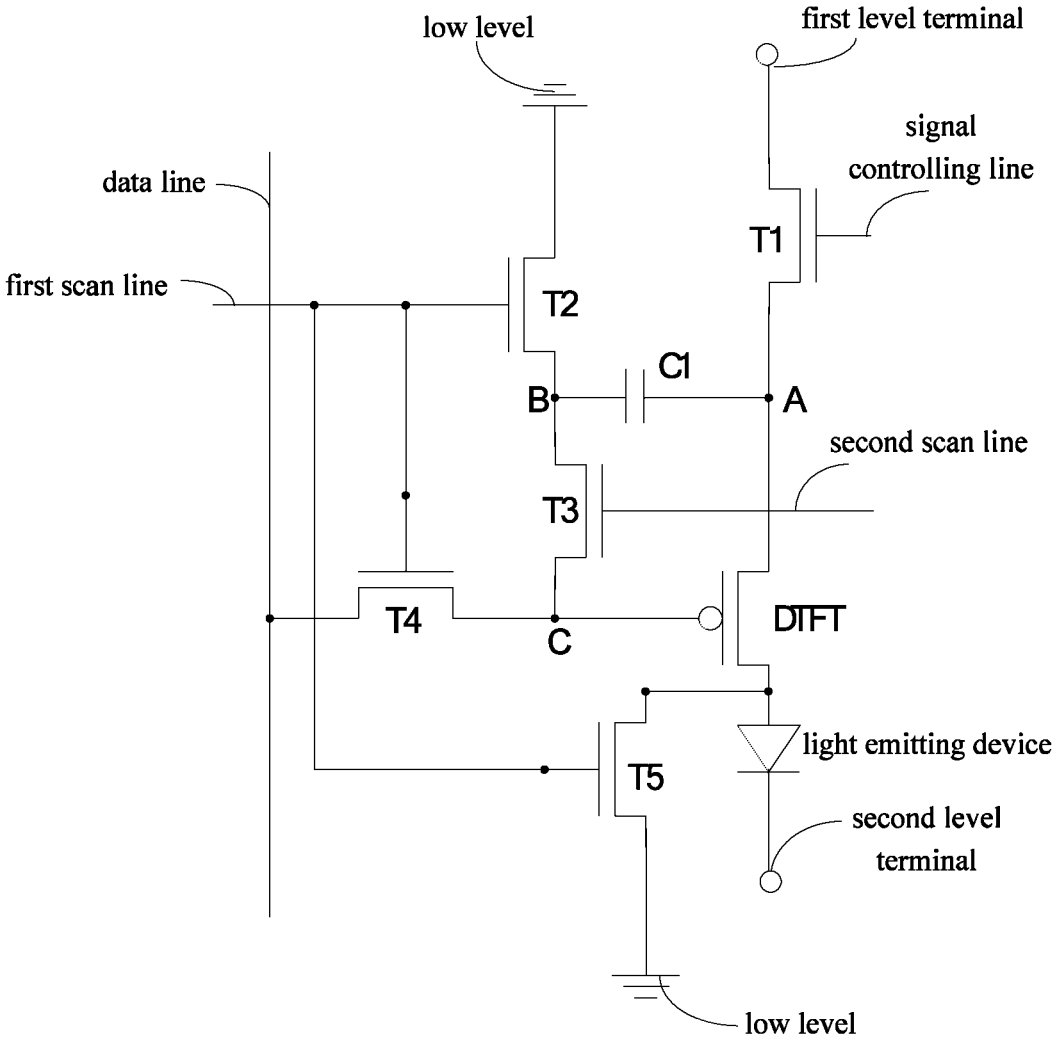
Figure 2B:
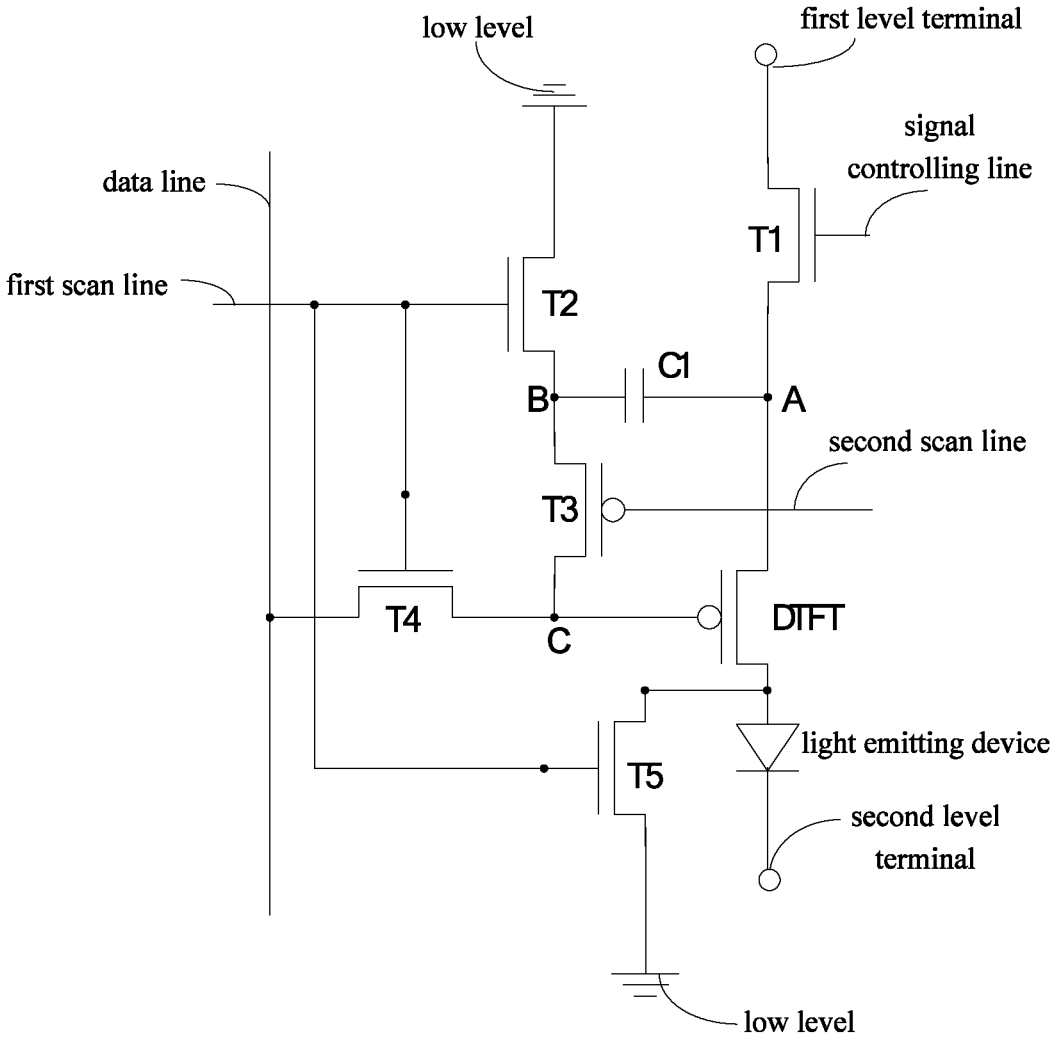

FIG. 2 is a pixel driving circuit provided in an embodiment of the present disclosure. As shown in FIG. 2, the circuit comprises a data line, a first scan line, a second scan line, a signal controlling line, a light emitting device, a storage capacitor C1, a driving transistor DTFT, a first switch transistor T1, a second switch transistor T2, a third switch transistor T3, a fourth switch transistor T4 and a fifth switch transistor 15.

a gate of the first switch transistor T1 is connected to the signal controlling line, a source of the first switch transistor T1 is connected to a first level terminal, and a drain of the first switch transistor T1 is connected to a first electrode A of the storage capacitor C1;

a gate of the second switch transistor T2 is connected to the first scan line, a source of the second switch transistor T2 is connected to a low level, and a drain of the second switch transistor T2 is connected to a second electrode B of the storage capacitor C1;

a gate of the third switch transistor T3 is connected to the second scan line, a source of the third switch transistor T3 is connected to the second electrode B of the storage capacitor C1;

a gate of the fourth switch transistor T4 is connected to the first scan line, a source of the fourth switch transistor T4 is connected to the data line, and a drain of the fourth switch transistor T4 is connected to the drain of the third switch transistor T3;

a gate of the driving transistor DTFT is connected to the drain of the fourth switch transistor T4 and a source of the driving transistor DTFT is connected to the first electrode of the storage capacitor C1;

a gate of the fifth switch transistor 15 is connected to the first scan line, a source of the fifth switch transistor T5 is connected to a drain of the driving transistor DTFT, and a drain of the fifth switch transistor T5 is connected to the low level;

one electrode of the light emitting device is connected to the drain of the driving transistor DTFT, and the other electrode of the light emitting device is connected to a second level terminal.

As an example, all of the first switch transistor T1, the second switch transistor 12, the fourth switch transistor 14 and the fifth switch transistor T5 are N-type switch transistors, the driving transistor DTFT is a P-type switch transistor, and the third switch transistor 13 is the N-type or P-type switch transistor.

As another example, all of the first switch transistor T1, the second switch transistor 12, the fourth switch transistor T4, the fifth switch transistor T5 and the driving transistor DTFT are the P-type switch transistors, and the third switch transistor T3 is the N-type or P-type switch transistor. Of course, if all the transistors are of the P-type in a manufacture process of a display panel, it is beneficial to decrease the manufacture processes and ensure the unity in device performances.

Figure 3:
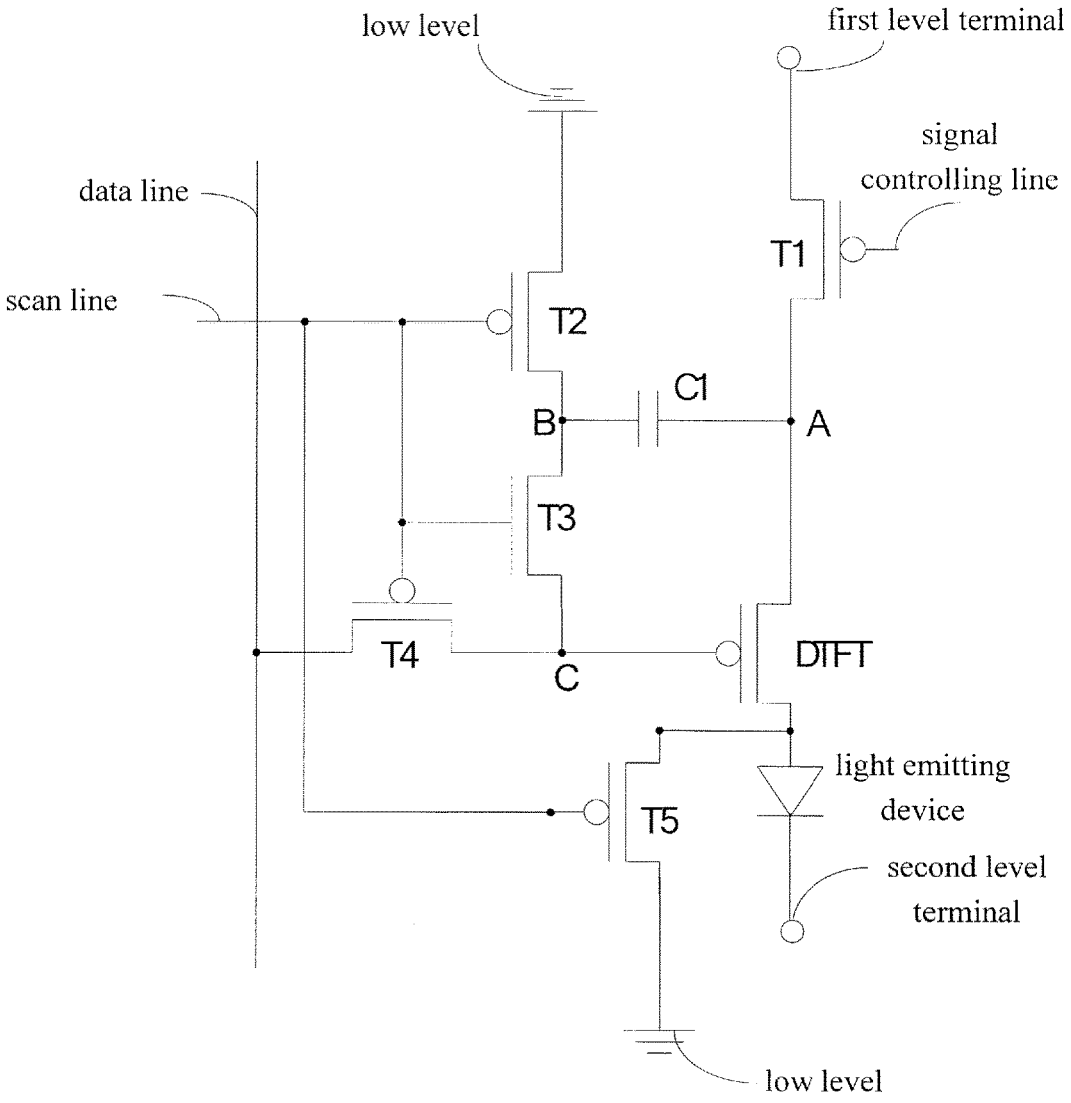
FIG. 3 is an exemplary view illustrating a structure of a pixel driving circuit provided in another embodiment of the present disclosure.

As a further example, the first scan line and the second scan line are inputted a same timing scan signal when the third witch transistor T3 adopts a different type of switch transistor from the types of the second switch transistor T2 and the fourth switch transistor T4. That is, the first scan line and the second scan line are inputted the same timing scan signal when the third switch transistor T3 is the P-type, the second switch transistor T2 and the fourth switch transistor 14 are the N-type, or when the third switch transistor T3 is the N-type, the second switch transistor T2 and the fourth switch transistor T4 are the P-type. At this time, as illustrated in FIG. 3, the gates of the third switch transistor T3, the second switch transistor 12 and the fourth switch transistor T4 may share a scan line in a manufacture process of a circuit, wherein the first switch transistor T1, the second switch transistor T2, the fourth switch transistor T4, the fifth switch transistor T5 and the driving transistor DTFT are the P-type, and the third switch transistor T3 is the N-type.

Of course, the light emitting device herein may be an active light emitting diode OLED (Organic Light Emitting Diode). When the OLED is a bottom-emitting OLED, a level $V_2$ at the second level terminal is lower than a level $V_1$ at the first level terminal. Exemplarily, the low level is a level at a ground terminal. Apparently, the configuration in FIG. 2 is illustrated by taking the bottom-emitting OLED as an example.

The pixel driving circuit provided in the embodiments of the present disclosure can avoid an influence on a driving current of an active light emitting device caused by a drift in a threshold voltage of a driving transistor in a manner of voltage compensation and improve the homogeneity in a displayed image. Furthermore, adopting the transistors having uniform types is benefit for reducing the manufacture processes.

The embodiments of the present disclosure provide also a driving method for the pixel driving circuits in the above respective embodiments. The method may perform the following operations:

in a first stage, the first switch transistor T1, the second switch transistor T2, the fourth switch transistor T4 and the fifth switch transistor T5 are turned on, the third switch transistor T3 is turned off, and the storage capacitor C1 is charged via the first level terminal;

in a second stage, the second switch transistor T2, the fourth switch transistor T4 and the fifth switch transistor T5 are turned on, the first switch transistor T1 and a third switch transistor T3 are turned off, the storage capacitor C1 is discharged until the voltage difference between the gate and the source of the driving transistor DTFT is equal to a threshold voltage of the driving transistor DTFT;

in a third stage, the first switch transistor T1 and the third switch transistor T3 are turned on, the second switch transistor T2, the fourth switch transistor T4 and the fifth switch transistor T5 are turned off, and an ON signal is applied to the light emitting device via the first level terminal and the second level terminal.

As an example, all of the first switch transistor T1, the second switch transistor T2, the fourth switch transistor T4 and the fifth switch transistor T5 are N-type switch transistors, the driving transistor DTFT is a P-type switch transistor, and the third switch transistor T3 is the N-type or P-type switch transistor.

As another example, all of the first switch transistor T1, the second switch transistor 12, the fourth switch transistor T4, the fifth switch transistor T5 and the driving transistor DTFT are the P-type switch transistors, and the third switch transistor T3 is the N-type or P-type switch transistor.

Figure 4:
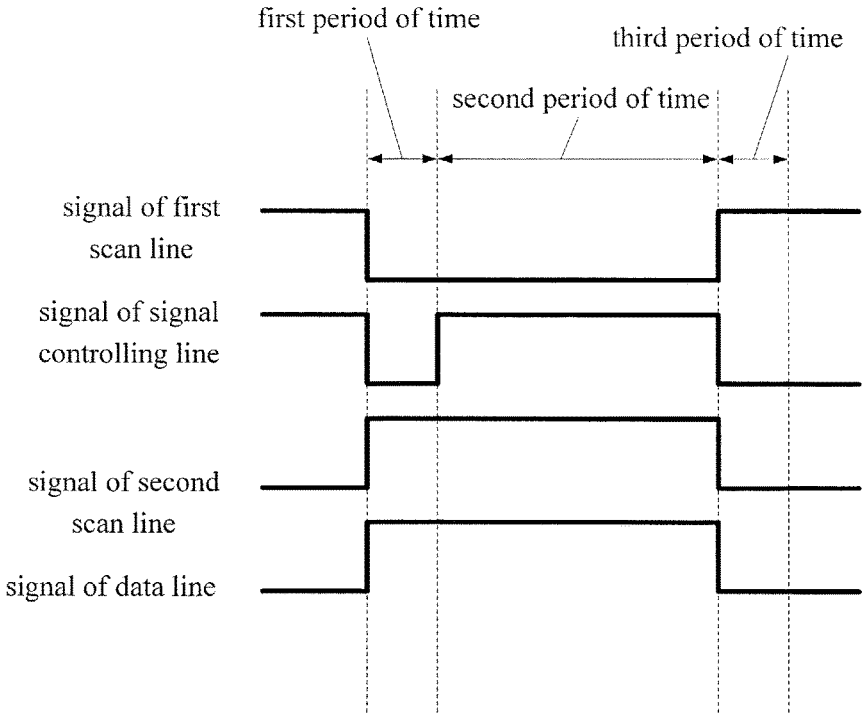
FIG. 4 is an exemplary view illustrating a signal timing state of the pixel driving circuit shown in FIG. 2 provided in the embodiment of the present disclosure.
Figure 5A:
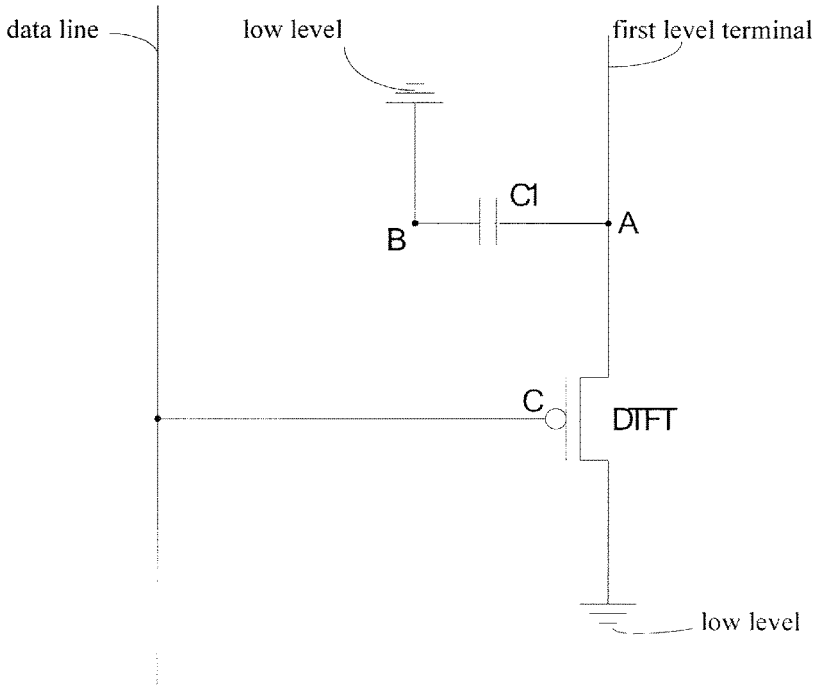
FIG. 5*a* is an exemplary view illustrating an equivalent circuit of the pixel driving circuit provided in the embodiment of the present disclosure during a first period of time.
Figure 5B:
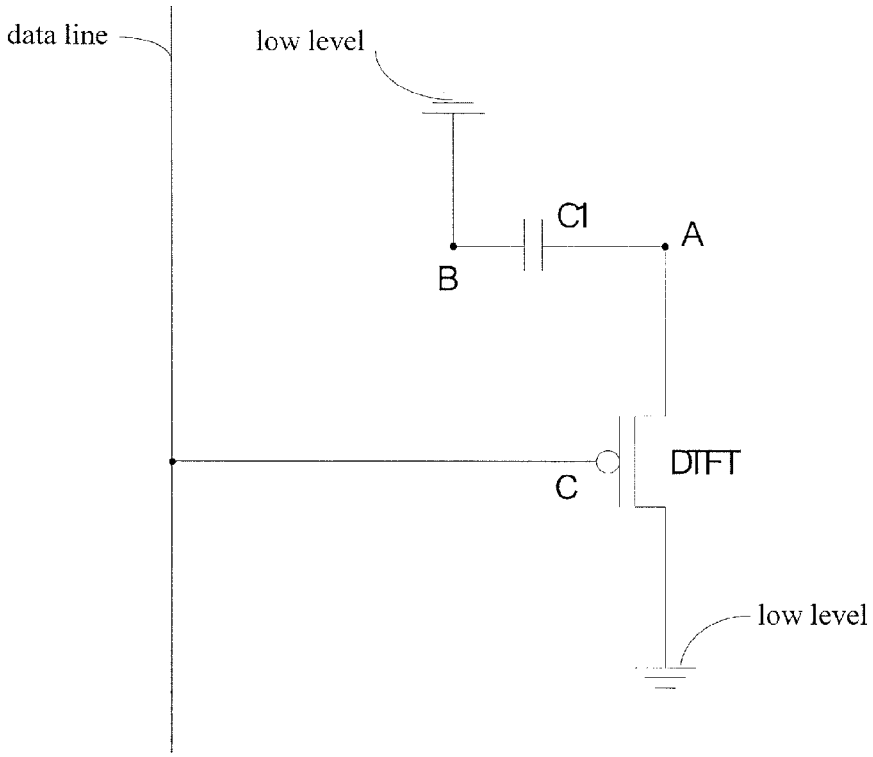
FIG. 5*b* is an exemplary view illustrating an equivalent circuit of the pixel driving circuit provided in the embodiment of the present disclosure during a second period of time.

Herein, all of the first switch transistor T1, the second switch transistor T2, the third switch transistor T3, the fourth switch transistor T4, the fifth switch transistor T5 and the driving transistor DTFT are illustrated as the P-type switch transistors. Referring to the pixel circuit shown in FIG. 2 and the schematic diagram of the signal timing state of the pixel driving circuit shown in FIG. 4, together with the schematic diagrams of the equivalent circuits of the pixel driving circuit in the operating states at respective stages shown in FIGS. 5*a*-5*c*, the embodiments of the present disclosure provide a driving method for the pixel driving circuit, comprising:

In the first stage, namely a first period of time illustrated in the schematic diagram of the timing states of FIG. 4, the signals on the first scan line and the signal controlling line are low level signals, the signals on the second scan line and the data line are high level signals, and thus the first switch transistor T1, the second switch transistor T2, the fourth switch transistor T4 an the fifth switch transistor T5 are turned on, the third switch transistor T3 is turned off. At this time, the fifth switch transistor T5 is turned on to short two terminals of the active light emitting diode OLED, and thus the storage capacitor C1 is charged by the first level terminal. The equivalent circuit diagram of the circuit formed at this time is as illustrated in FIG. 5*a*. During this process, a voltage at the first electrode of the storage capacitor C1, namely a voltage at the point A in the drawings, is charged to be as the same as a voltage of the first level terminal, that is to say, the voltage $V_A$ at the point A is equal to the voltage $V_1$ of the first level terminal, and the second electrode of the storage capacitor C1 is connected to the low level thereby the voltage at the second electrode, namely a voltage at the point B, $V_B=0$.

In the second stage, namely a second period of time illustrated in the schematic diagram of the timing states of FIG. 4, the signal on the first scan line is the low level signal, the signals on the second scan line, the signal controlling line and the data line are the high level signals, and thus the second switch transistor T2, the fourth switch transistor T4, the fifth switch transistor T5 are turned on, and the first switch transistor T1 and the third switch transistor T3 are turned off. At this time, the fifth switch transistor T5 is still turned on to short the two terminals of the active light emitting diode OLED, and the storage capacitor C1 is discharged until a voltage difference between the gate and the source of the driving transistor DTFT is equal to a threshold voltage of the driving transistor DTFT. The equivalent circuit diagram of the circuit formed at this time is as illustrated in FIG. 5*h*. During this process, the first electrode of the storage capacitor C1, namely the point A in the drawings, starts to be discharged until $V_A-V_C=V_{th}$, where $V_A$ is the voltage at the point A, $V_C$ is the voltage at a point C, that is, the gate voltage of the driving transistor DTFT and $V_C=V_{data}$ at this time, and where $V_{data}$ is a voltage value provided by the data line, $V_{th}$ is the threshold voltage of the driving transistor DTFT at this time. At last, the voltage at the point A becomes $V_{data}+V_{th}$. This stage is a compensation stage and performs a buffering function so as to be prepared for the next stage.

Figure 5C:
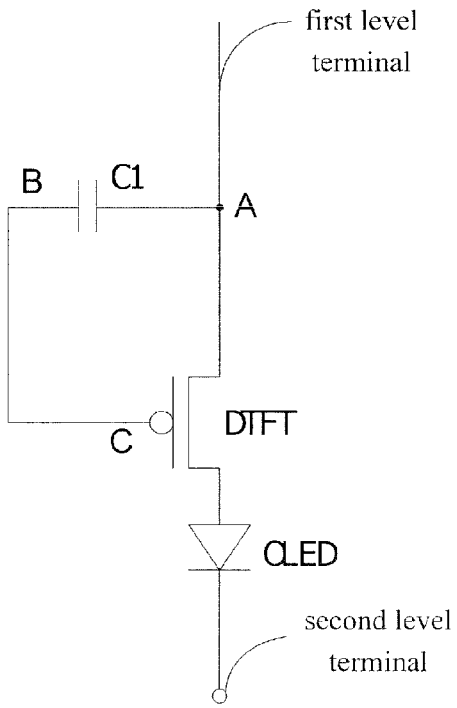
FIG. 5*e* is an exemplary view illustrating an equivalent circuit of the pixel driving circuit provided in the embodiment of the present disclosure during a third period of time.

In the third stage, namely a third period of time illustrated in the schematic diagram of the timing state of FIG. 4, the signal on the first scan line is the high level signal, the signals on the data line, the second scan line and the signal controlling line are the low level signals, the first switch transistor T1 and the third switch transistor T3 are turned on, the second switch transistor T2, the fourth switch transistor T4 and the fifth switch transistor T5 are turned off, and thus the first level terminal and the second level terminal apply an ON signal to the light emitting device. The equivalent circuit diagram of the circuit formed at this time is as illustrated in FIG. 5*c*. During this process, the voltage at the first electrode A of the storage capacitor C1 returns back to the voltage value $V_1$, which is the same as the voltage of the first level terminal, and the second electrode B of the storage capacitor C1 is floating. At this time, the voltages at the first electrode and the second electrode jump equally, then $V_B=V_C=V_1-V_{data}-V_{th}$, and the active light emitting device starts to emit light, wherein a driving current is according to a formula as follows:

$$I_{OLED}=K[V_{GS}-V_{th}]^2=K[V_1-(V_1-V_{data}-V_{th})-V_{th}]^2=K\cdot V_{data}^2.$$

It can be seen from the above formula that the driving current $I_{OLED}$ only relates to a voltage value $V_{data}$ of the data line, therefore the driving current is not affected by the $V_{th}$, wherein $V_{GS}$ is a voltage between the gate and the source of a TFT, $$K=\frac{1}{2}\mu C_{ox}\frac{W}{L},$$

μ and $C_{ox}$ are process constants, W is a channel width of the TFT, L is a channel length of the thin film transistor, the W and L are constants which may be designed selectively.

The above description is explained by taking the light emitting device being the bottom-emitting OLED as an example, that is, a level at the first level terminal is higher than that at the second level terminal. Further, it may conceive that the second level terminal may be connected to a low level directly when the light emitting device adopts the bottom-emitting OLED, namely, a negative electrode of the OLED is connected to the low level, so that a design difficulty of the pixel driving circuit may be reduced too, which facilitates a circuit layout.

The above description is explained by taking the case in which all of the first switch transistor T1, the second switch transistor T2, the third switch transistor T3, the fourth switch transistor T4, the fifth switch transistor T5 and the driving transistor DTFT are the P-type switch transistors as an example. Adopting the transistors all having the P-type in the manufacture process of a display panel may be also benefit for reducing the processes and ensure homogeneity in the device performances. Of course, when the first switch transistor T1, the second switch transistor T2, the third switch transistor T3, the fourth switch transistor T4 and the fifth switch transistor T5 are the N-type switch transistors while the driving transistor DTFT is the P-type switch transistor, only level signals applied from the first scan line, the second scan line, the signal controlling line and the data line need to be adjusted correspondingly. That is to say, the embodiments of the present disclosure have no limitations to the types of the respective switch transistors and the driving transistor, and only the level signals applied from the first scan line, the second scan line, the signal controlling line and the data line need to be adjusted when the types of the respective switch transistors and the driving transistor change, as long as the driving method for the pixel driving circuit according to the embodiments of the present disclosure can be realized. Any combination conceived easily and implemented by those ordinary skilled in the art based on the pixel driving circuit and the driving method provided in the embodiments of the present disclosure may fall into the protection scope of the present disclosure.

Figure 6:
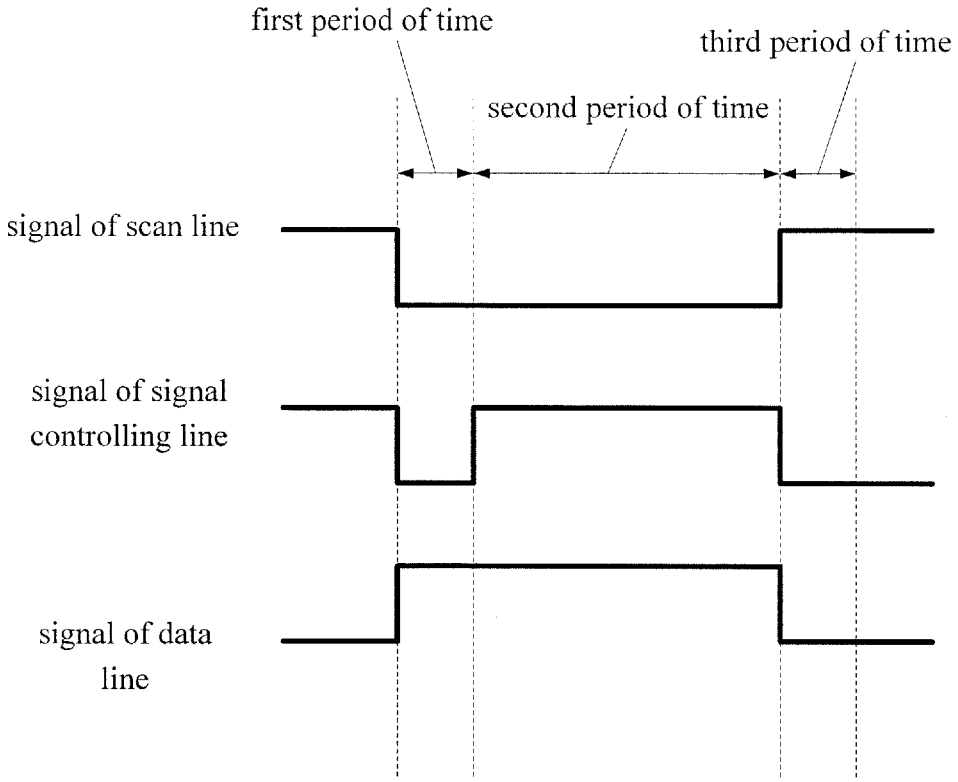
FIG. 6 is an exemplary view illustrating a signal timing state of the pixel driving circuit shown in FIG. 3 provided in the embodiment of the present disclosure.

As shown in FIG. 6, the embodiments of the present disclosure also provide an exemplary view of a signal timing state corresponding to the pixel driving circuit shown in FIG. 3. Since only the types of the switch transistors change, its operation principle and equivalent circuit diagrams in respective stages may refer to FIGS. 5*a*~5*c* and their corresponding descriptions, and details are omitted herein.

The driving method for the pixel driving circuit provided in the embodiments of the present disclosure may avoid an influence on a driving current of an active light emitting device caused by a drift in a threshold voltage of a driving transistor in a manner of voltage compensation and in turn improve homogeneity in a displayed image. Furthermore, adopting the transistors having uniform type is benefit for reducing the manufacture processes.

According to a further aspect of the present disclosure, there is provided an array substrate, comprising:

a plurality of data lines arranged in a column extension;

a plurality of first scan lines, second scan lines and signal controlling lines arrange in a row extension;

a plurality of pixels disposed at intersections between the data lines and the scan lines in a form of array;

wherein the pixel comprise any one of the pixel driving circuits described above.

The array substrate provided in the embodiments of the present disclosure may avoid an influence on a driving current of an active light emitting device caused by a drift in a threshold voltage of a driving transistor in a manner of voltage compensation and may in turn improve a homogeneity in a displayed image According to a still further aspect of the present disclosure, there is provided a display apparatus comprising the above array substrate. Further, the display apparatus may be any display device such as a piece of electronic paper, a mobile phone, a television, a digital photo frame, etc.

The display apparatus provided in the embodiments of the present disclosure may avoid an influence on a driving current of an active light emitting device caused by a drift in a threshold voltage of a driving transistor in a manner of voltage compensation and may in turn improve a homogeneity in a displayed image.

The above are only exemplary embodiments of the disclosed solution, but the scope sought for protection is not limited thereto. Instead, any or all modifications or replacements as would be obvious to those skilled in the art are intended to be included within the scope of the present invention. Therefore, the scope of the present invention is defined in the appended claim.

What is claimed is:

1. A pixel driving circuit, comprising a data line, a first scan line, a second scan line, a signal controlling line, a light emitting device, a storage capacitor, a driving transistor, a first switch transistor, a second switch transistor, a third switch transistor, a fourth switch transistor and a fifth switch transistor, wherein a gate of the first switch transistor is connected to the signal controlling line, a source of the first switch transistor is connected to a first level terminal, and a drain of the first switch transistor is connected to a first electrode of the storage capacitor;

a gate of the second switch transistor is connected to the first scan line, a source of the second switch transistor is connected to a low level, and a drain of the second switch transistor is connected to a second electrode of the storage capacitor;

a gate of the third switch transistor is connected to the second scan line, a source of the third switch transistor is connected to the second electrode of the storage capacitor;

a gate of the fourth switch transistor is connected to the first scan line, a source of the fourth switch transistor is connected to the data line, and a drain of the fourth switch transistor is connected to the drain of the third switch transistor;

a gate of the driving transistor is connected to the drain of the fourth switch transistor, and a source of the driving transistor is connected to the first electrode of the storage capacitor;

a gate of the fifth switch transistor is connected to the first scan line, a source of the fifth switch transistor is connected to a drain of the driving transistor, and a drain of the fifth switch transistor is connected to the low level; and one electrode of the light emitting device is connected to the drain of the driving transistor, and the other electrode of the light emitting device is connected to a second level terminal, in a first stage, turning the first switch transistor, the second switch transistor, the fourth switch transistor and the fifth switch transistor on, turning the third switch transistor off, and charging the storage capacitor by the first level terminal;

in a second stage, turning the second switch transistor, the fourth switch transistor and the fifth switch transistor on, turning the first switch transistor and the third switch transistor off, discharging the storage capacitor until a voltage difference between a gate and a source of the driving transistor is equal to a threshold voltage of the driving transistor;

in a third stage, turning the first switch transistor and the third switch transistor on, turning the second switch transistor, the fourth switch transistor and the fifth switch transistor off, and applying an ON signal to the light emitting device by the first level terminal and the second level terminal.

2. The pixel driving circuit of claim 1, wherein, all of the first switch transistor, the second switch transistor, the fourth switch transistor and the fifth switch transistor are N-type switch transistors, the driving transistor is a P-type switch transistor, and the third switch transistor is the N-type or P-type switch transistor.

3. The pixel driving circuit of claim 2, wherein the first scan line and the second scan line are inputted a same timing scan signal when the third switch transistor adopts a different type of switch transistor from that of the second switch transistor and the fourth switch transistor.

4. The pixel driving circuit of claim 1, wherein, all of the first switch transistor, the second switch transistor, the fourth switch transistor, the fifth switch transistor and the driving transistor are the P-type switch transistors, and the third switch transistor is the N-type or P-type switch transistor.

5. The pixel driving circuit of claim 4, wherein the first scan line and the second scan line are inputted a same timing scan signal when the third switch transistor adopts a different type of switch transistor from that of the second switch transistor and the fourth switch transistor.

6. The pixel driving circuit of claim 1, wherein the first scan line and the second scan line are inputted a same timing scan signal when the third switch transistor adopts a different type of switch transistor from that of the second switch transistor and the fourth switch transistor.

7. An array substrate, comprising a pixel driving circuit which comprises a data line, a first scan line, a second scan line, a signal controlling line, a light emitting device, a storage capacitor, a driving transistor, a first switch transistor, a second switch transistor, a third switch transistor, a fourth switch transistor and a fifth switch transistor, wherein a gate of the first switch transistor is connected to the signal controlling line, a source of the first switch transistor is connected to a first level terminal, and a drain of the first switch transistor is connected to a first electrode of the storage capacitor;

a gate of the second switch transistor is connected to the first scan line, a source of the second switch transistor is connected to a low level, and a drain of the second switch transistor is connected to a second electrode of the storage capacitor;

a gate of the third switch transistor is connected to the second scan line, a source of the third switch transistor is connected to the second electrode of the storage capacitor;

a gate of the fourth switch transistor is connected to the first scan line, a source of the fourth switch transistor is connected to the data line, and a drain of the fourth switch transistor is connected to the drain of the third switch transistor;

a gate of the driving transistor is connected to the drain of the fourth switch transistor, and a source of the driving transistor is connected to the first electrode of the storage capacitor;

a gate of the fifth switch transistor is connected to the first scan line, a source of the fifth switch transistor is connected to a drain of the driving transistor, and a drain of the fifth switch transistor is connected to the low level; and one electrode of the light emitting device is connected to the drain of the driving transistor, and the other electrode of the light emitting device is connected to a second level terminal, in a first stage, turning the first switch transistor, the second switch transistor, the fourth switch transistor and the fifth switch transistor on, turning the third switch transistor off, and charging the storage capacitor by the first level terminal;

in a second stage, turning the second switch transistor, the fourth switch transistor and the fifth switch transistor on, turning the first switch transistor and the third switch transistor off, discharging the storage capacitor until a voltage difference between a gate and a source of the driving transistor is equal to a threshold voltage of the driving transistor;

in a third stage, turning the first switch transistor and the third switch transistor on, turning the second switch transistor, the fourth switch transistor and the fifth switch transistor off, and applying an ON signal to the light emitting device by the first level terminal and the second level terminal.

8. The array substrate of claim 7, wherein, all of the first switch transistor, the second switch transistor, the fourth switch transistor and the fifth switch transistor are N-type switch transistors, the driving transistor is a P-type switch transistor, and the third switch transistor is the N-type or P-type switch transistor.

9. The array substrate of claim 8, wherein the first scan line and the second scan line are inputted a same timing scan signal when the third switch transistor adopts a different type of switch transistor from that of the second switch transistor and the fourth switch transistor.

10. The array substrate of claim 7, wherein, all of the first switch transistor, the second switch transistor, the fourth switch transistor, the fifth switch transistor and the driving transistor are the P-type switch transistors, and the third switch transistor is the N-type or P-type switch transistor.

11. The array substrate of claim 10, wherein the first scan line and the second scan line are inputted a same timing scan signal when the third switch transistor adopts a different type of switch transistor from that of the second switch transistor and the fourth switch transistor.

12. The array substrate of claim 7, wherein the first scan line and the second scan line are inputted a same timing scan signal when the third switch transistor adopts a different type of switch transistor from that of the second switch transistor and the fourth switch transistor.

13. A display apparatus, comprising:

the array substrate of claim 7.

* * * * *